United States Patent [19]

Serrone

[11] 3,995,580

[45] Dec. 7, 1976

[54] FLAG WAVING DEVICE

[76] Inventor: Peter J. Serrone, 409 Garfield, Kansas City, Mo. 64124

[22] Filed: Mar. 10, 1976

[21] Appl. No.: 665,631

[52] U.S. Cl. ..... 116/173; 116/174

[51] Int. Cl.[2] ..... G09F 17/00

[58] Field of Search ..... 116/174, 173, 175; 40/218, 138, 139

[56] References Cited

UNITED STATES PATENTS

| | | | |
|---|---|---|---|
| 1,294,032 | 2/1919 | Bixby | 116/173 |
| 1,448,299 | 3/1923 | Holliday | 116/174 |
| 1,801,518 | 4/1931 | Matteson | 116/174 |
| 2,284,209 | 5/1942 | Holm | 116/173 |
| 2,302,524 | 11/1942 | Borregard | 116/173 |
| 2,368,783 | 2/1945 | Schillinger | 116/174 |

*Primary Examiner*—S. Clement Swisher
*Assistant Examiner*—Denis E. Corr
*Attorney, Agent, or Firm*—Schmidt, Johnson, Hovey & Williams

[57] ABSTRACT

A device is provided for displaying a flag or the like in waving condition, wherein such condition is produced or simulated by mechanical means, rather than by the effects of air currents. The device employs a rotatably supported pole, to which one edge of the flag is secured; a support element, to which another edge of the flag is secured, extending laterally from the pole and rotatable with the latter; and drive means for oscillating the pole about its axis through an angular rotation of less than 90 degrees.

8 Claims, 5 Drawing Figures

FLAG WAVING DEVICE

BACKGROUND OF THE INVENTION

This invention relates to apparatus for displaying flags, banners or the like, and, more particularly, to apparatus for displaying such objects in an appealing manner, which mechanically emulates the waving motion that would be naturally produced by the effects of wind, if it were present.

A flag waving in the wind attracts the attention and admiration of almost everyone; its motion enhances its symbolism with a character of vitality, whereas a still flag tends to make a less meaningful and pleasant impression upon the beholder. Yet flags are often displayed indoors or under other circumstances in which there are no natural wind currents to produce the desired waving motion effect. The only prior efforts to solve the problem, which are known to me, have involved using a fan or the like to produce and direct artificial air currents toward the flag in an attempt to simulate the effects of natural wind, but such efforts have proved less than fully satisfactory for a number of reasons including the noise or other side effects generated, the energy requirements to produce artificial air currents of sufficient magnitude, the frequent difficulty of properly locating a fan relative to the position at which the flag is to be displayed, etc.

SUMMARY OF THE INVENTION

Accordingly, this invention is aimed at achieving a more direct, practical and economical solution to the noted problem by providing simple and efficient apparatus for mechanically inducing the motions of a flag required to effectively simulate its waving in the wind. Such result is accomplished by means not requiring air currents at all, but rather by employing an additional supporting or coupling element between the flag and the pole to which the flag is secured, in conjunction with means normally requiring relatively little power for oscillating the pole, and thereby such supporting element, through a limited arc of rotation about the axis of the pole. The simplicity of the mechanism minimizes maintenance requirements, and, once actuated, the apparatus continues to function without operator attention until turned off. The invention is usable either indoors or outdoors, with flags of a wide range of sizes, and with flags displayed from poles having their axes disposed either vertically or at various inclinations from vertical. Further objects of the invention will be made clear or become apparent from the more detailed description hereinafter of my currently preferred embodiment of the invention, which is exemplary and illustrative of the manner in which my invention may be applied.

DESCRIPTION OF PREFERRED EMBODIMENT

Figure 1:
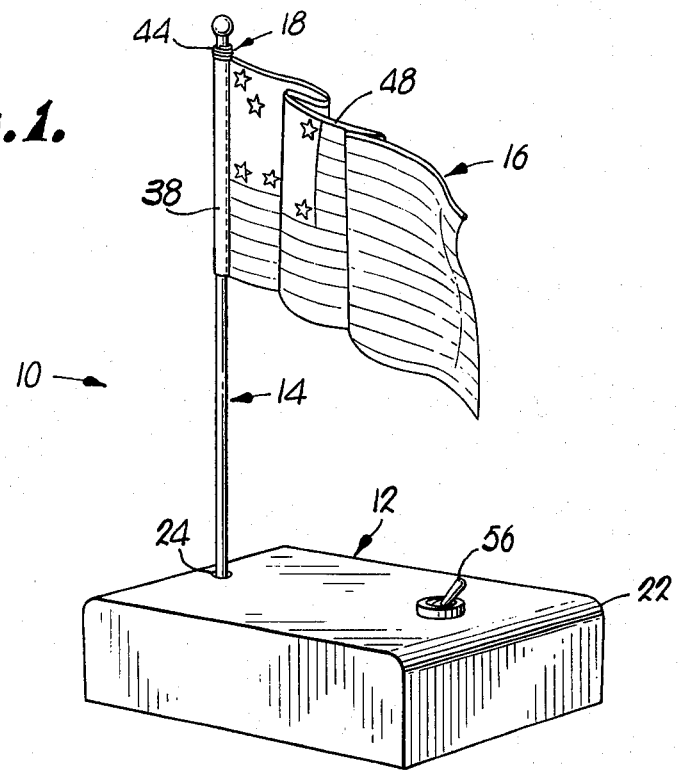
FIG. 1 is a perspective view of the device constituting my currently preferred embodiment of the invention, which illustrates the application of the principles of the invention to a relatively small, desk top type, flag displaying device.

Although it is to be understood that the invention is applicable to flags of any reasonable size commonly displayed, merely with appropriate resizing of the other elements of the apparatus and other minor changes of constructional details to conform to the strengths required and what is most convenient in constructing apparatus of any particular size, the principles of the invention should become amply clear from consideration of my currently preferred embodiment, which is a desk top size display device for a flag only about four inches long and three inches wide. Indeed, the ability of the invention to achieve the desired simulation of the waving effect of natural wind currents with a flag so small is indicative of the surprisingly effective nature of the purely mechanical waving simulation technique employed by the invention.

The flag waving device, as shown and generally designated 10 in the drawings, broadly includes a base 12, a pole 14, a flag 16, a support element 18 and a power and drive unit 20.

The base 12 includes an upper housing 22 which is provided with an opening 24 for clearing the lower portion of the pole 14, secured (preferably removably to permit access to the components within housing 22, when needed) in any suitable fashion to a bottom wall 26, which is provided with a bracket 28 for stationarily mounting a motor 30 forming a part of the unit 20 and with means 32 hereinafter further described for rotatably mounting the pole 14 on the base 12. As will be apparent for the desk top size device 10 or other relatively small embodiments of the invention to be used in household, office or television studio surroundings, the housing 22 may have any suitable decorative design; it should be pointed out, however, that the illusion of naturally induced waving motion of the flag 16 is preserved and enhanced even with outdoor or other full sized flags by employing some sort of appropriate housing or covering 22 over the power and drive unit 20, in order that the observer will distinctly perceive motion (or cause therefor) only in the flag 16.

The pole 14 in the device 20 is of sufficient length for the flag 16 to be mounted thereon at an aesthetically pleasing height above the housing 22 and is also, preferably from the standpoint of general appearance, disposed substantially vertically in smaller flag embodiments of the invention; in larger flag embodiments or special applications, however, it may be desirable to incline the pole 14 away from vertical or to shorten the pole 14 so that the flag 16 is closely adjacent the enclosure 22 or both. In any case, the end portion of the pole 14 remote from the flag 16 must be mounted for oscillatory rotation about its longitudinal axis upon the base 12. In the desk top sized device 10, such rotatable mounting means 32 for the pole 14 is simply and effectively provided by an upstanding sleeve 34 formed or suitably mounted on the bottom wall 26, into which sleeve 34 a lower length of the pole 14 rotatably fits in the manner of a shaft within a bearing, together with a friction-reducing pointed end 36 formed on the lower extremity of the pole 14 for supporting the latter upon the bottom wall 26 without creating substantial resistance to rotation of the pole 14. In embodiments for waving substantially larger flags, it will be apparent to those skilled in the art that the means 32 may employ a stronger and more sophisticated type of bearing arrangement for rotatably mounting the flag 16.

The flag 16, as previously noted, may be of any appropriate size desired for a particular application (with the size and construction of the other elements of the device 10 adjusted accordingly), and, although depicted for illustration as rectangular in the preferred device 10, may also be of other shapes customarily found in banners. The end edge 38 of the flag 16, that is, the edge thereof which is to be adjacent the pole 14, must be suitably "secured" to the pole 14, in the sense that the edge 38 will not drop or "ride down" the pole 14 during oscillation of the latter, but will tend to remain extended along and adjacent to the proximate stretch of the pole 14. In the desk top size embodiment of device 10, such "securement" is jointly provided by the subsequently described relationship between the flag 16 and the support or coupling element 18, and by a marginal portion of the flag 16 along the edge 38 thereof being formed by folding and stitching or the like as at 40 into a tubular sleeve 42 of the fabric of the flag 16 for embracing the pole 14. With flags 16 and poles 14 of substantially larger size, the last-mentioned aspect of the securement may be provided by ties along the edge 38 of the flag 16 tied to the pole 14 or other suitable fastening means (including permanent bonding or connectors, although some releasable type of "securement" is preferable to facilitate periodic removal of the flag 16 for cleaning).

The elongate, rod-like support or coupling element 18 is vital to the waving simulation function of the device 10. The element 18 significantly should have properties such that it can either be formed or is bendable into and will essentially retain a generally sinuous configuration, but will then also possess a capacity for further resilient deflection from and return toward its normal sinuous configuration to sustain vibrations therealong (which it appears significantly include motions of the resonant or standing wave type). In the small size, preferred embodiment device 10, the element 18 is conveniently and workably formed of steel wire of about 18 or 20 gauge, and the element 18 is mounted on the pole 14 adjacent the upper end of the latter by forming a small coil 44 at one end of the element 18 which tightly grips the pole 14 when the coil 44 is fitted onto the latter. The remaining portion 46 of the element 18, which extends generally laterally from the pole 14, is "secured" to the upper edge 48 of the flag 16 as by folding and stitching (as at 50) a marginal portion of the flag 16 along edge 48 thereof to present a fabric sleeve 52 embracing the portion 46 of the element 48. Thus, the element 18 serves to assist in supporting the flag 16 on the pole 14, as well as being instrumental in the production and control of the desired waving motions of the flag 16, in response to rotative oscillation of the pole 14 and element 18 as hereinafter more fully described.

Before leaving present consideration of the relationship between the flag 16 and the element 18, however, it is noted that, after securement of the edge 48 of flag 16 thereto, the portion 46 of the element 18 is preferably bent to form the same into a normal sinuous configuration having alternately opposite, horizontal curvatures (shown somewhat exaggeratedly in FIG. 1) for "pre-setting" a corresponding "wavy" normal configuration for the upper edge 48 of the flag 16. Such "wavy" normal configuration of the edge 48, although apparently not essential for the production of the "waving" motions of the flag 16 during oscillation, does enhance the over-all effect and, by virtue of the possible influence thereof upon the resonance properties of various lengths of the portion 46 of the element 18, is believed to facilitate the formation of appropriate vibrations for realistically simulating natural wind induced waving of the flag 16. Those skilled in the art will appreciate that devices 10 for waving larger sized flags 16 will require correspondingly larger and stronger elements 18 of metal (or, perhaps, certain plastics), and that various conventional means other than a coil 44 may be employed for mounting the element 18 on the pole 14 for generally horizontal swinging movement as the pole 14 is rotated.

Figure 4:
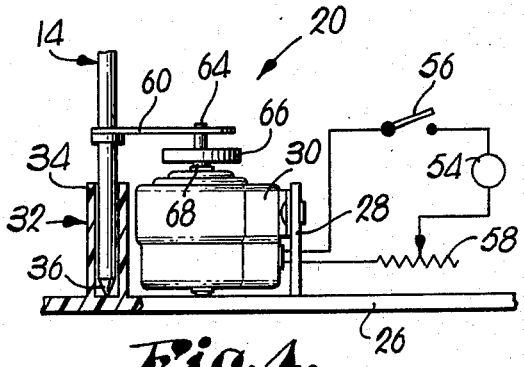
FIG. 4 is a fragmentary side elevational view of the oscillation power and drive unit and a portion of the pole and the base of the device of FIG. 1, with certain parts broken away and shown in section for greater clarity, and with certain electrical components also illustrated schematically.

The motor 30 of the power and drive unit 20 is preferably of the electric type and, in the small size preferred embodiment of device 10, may be an inexpensive, small electric motor such as commonly employed in clocks and the like. Means for energizing the motor 30 are shown schematically in FIG. 4 and include a suitable electric power source 54, which may be a battery accommodated within the housing 22 in smaller embodiments, which source 54 is electrically coupled with the motor 30 through an on-off switch 56, which may be conveniently mounted on the housing 22 as shown in FIG. 1, and, desirably, a rheostat 58 for adjusting the speed of the motor 30.

Figure 2:
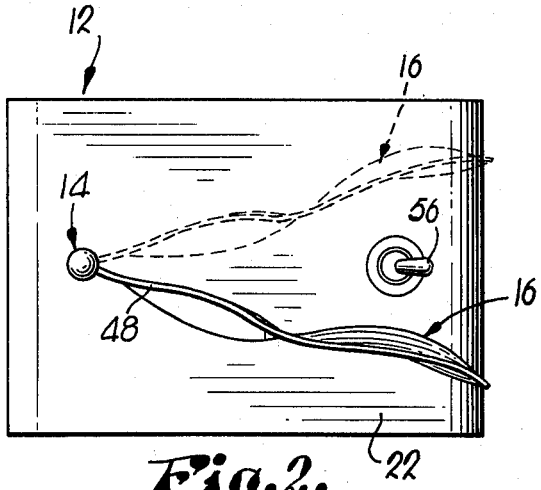
FIG. 2 is a top plan view of the device of FIG. 1, with the flag shown in two instantaneous positions thereof occurring within its range of oscillation.
Figure 3:
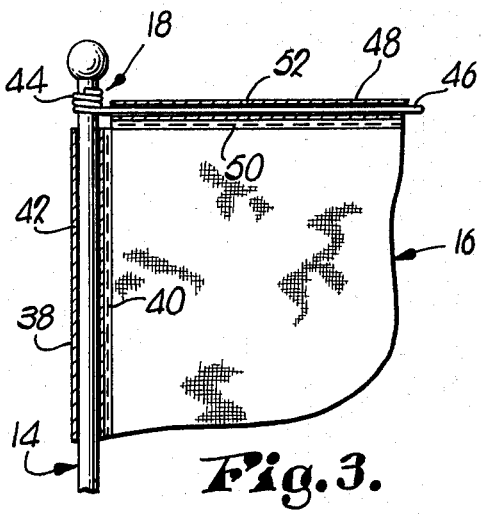
FIG. 3 is a fragmentary side elevational view of a portion of the pole, the flag and the support element of the device of FIG. 1, with certain parts broken away and shown in section for greater clarity.
Figure 5:
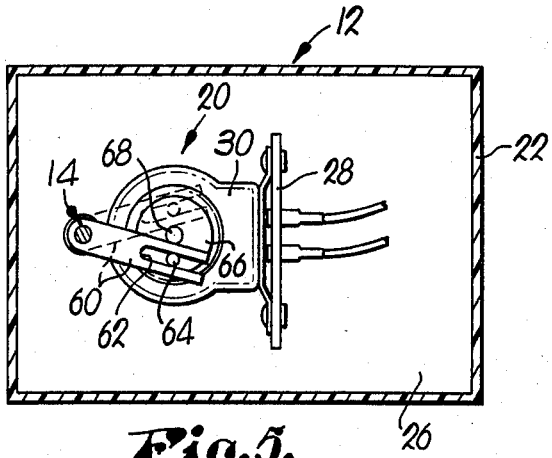
FIG. 5 is a top plan view of the oscillation power and drive unit and its coupling with the pole of the device of FIG. 1, with the side walls of the base being shown in section.

The motor 30 may be coupled with the pole 14 for oscillating the latter through a suitable rotational arc in various ways according to the size of the flag 16 to be handled and the forces thus involved. In the small size device 10, I have found quite satisfactory and employ an arm 60 suitably secured to and extending laterally from the pole 14, which arm 60 is provided with a longitudinal follower slot 62 therein at the end thereof remote from the pole 14. Slidably received within the slot 62 is an upstanding stud 64 eccentrically mounted upon a disc 66 secured to and rotatable with the shaft 68 of the motor 30. As will be apparent from FIG. 5, wherein opposite extreme positions of oscillatory movement of the arm 60 are shown in solid and dotted lines respectively, when the motor 30 is running to rotate the disc 66, the eccentric stud 64 will move longitudinally within the slot 62, thereby swinging the arm 60 continuously back and forth between the extremes of its oscillatory movement. As the arm 60 is thus swung in oscillatory fashion, the pole 14 to which the arm 40 is secured will similarly be oscillated through a corresponding arc of angular rotation. As illustrated in FIG. 2, such oscillation of the pole 14 causes the support element 18, and thereby the top edge 48 of the flag 16, to also be oscillated continuously back and forth between the extreme positions thereof illustrated in solid and dotted lines respectively. It should be observed that the angular range of oscillation does not appear to be particularly critical, assuming that appropriate adjustments of the speed of oscillation can be made as with the rheostat 58, although it further appears that optimum results are achieved with the angle of oscillation being restricted to less than 90%. The desired amount of angular range of the oscillation may, of course, be determined by the distance that the eccentric stud 64 is displaced from the center line of the motor shaft 68 in relation to the length of the arm 60 which is employed.

As nearly as can be determined from observation of the device 10, the overall "waving" effect upon the flag 16, which so closely emulates the appearance of a flag in natural wind currents, is achieved through a combination of two different, although not necessarily independent, mechanical actions. First, the oscillatory movement of the supporting element 18 and top edge 48 of the flag 16 through the atmosphere surrounding the flag 16, of itself, produces a waving motion in the lower portions of the flag 16. Secondly, however, that waving motion is supplemented and, perhaps, modified by agitation forces induced into the flag 16 by the vibratoy motions of the resilient support element 18. Because of the resilient nature of the element 18 and the fact that its motion is oscillatory in character, the element 18 appears to vibrate or undergo continuously changing deformations from its normal configuration, which, as best now understood, seem to be of "standing wave" or harmonic character along the length of the portion 46 of the element 18, which are apparently dependent upon the length and resilience characteristics of the portion 46 and the speed at which the same is oscillated. Thus, it has been observed that the desired waving effect in the flag 16 can be optimized for a device 10 of given size and construction by adjusting the rheostat 58 for a speed of oscillation at which the vibrations along the portion 46 of the element 18 are most pleasing with the particular size of flag 16 being manipulated. Once such adjustment has been initially made for a given device 10, it should not require frequent alterations thereafter so that the rheostat 58 may conveniently be simply enclosed within the housing 22 adjacent the battery 54.

As will be apparent to those skilled in the art various minor modifications and changes in details of construction may be employed without departing from the real gist and essence of the invention and, indeed, a certain amount of adaptation of constructional details to the size of flag to be displayed is necessarily contemplated, as hereinbefore pointed out. Accordingly, it should be understood that my invention should be deemed limited only by the fair scope of the claims that follow, including mechanical equivalents thereof.

I claim:

1. In a device for displaying a flag or the like in waving condition:

base means;

elongate pole means;

means for mounting said pole means on said base means for rotative movement of said pole means about the longitudinal axis thereof;

flexible flag means to be displayed having a pair of angularly offset edges;

means for securing said flag means to said pole means along one of said edges of said flag means;

elongate support means secured at one extremity thereof to said pole means, extending laterally from said pole means, and secured to said flag means along the other of said edges of said flag means; and drive means operably coupled with said pole means for rotatively oscillating the latter about said longitudinal axis thereof.

2. The invention of claim 1, wherein the longitudinal axis of said pole means is generally upright.

3. The invention of claim 1, wherein said support means extends along the upper-most edge of said flag means.

4. The invention of claim 1, wherein said support means has a non-linear, generally sinuous configuration.

5. The invention of claim 1, wherein said support means is bendable to permit forming the same into various non-linear configurations.

6. The invention of claim 1, wherein said support means is resilient and adapted to vibrate, as well as to swing through a primary arc, in response to oscillatory movement of said pole means.

7. The invention of claim 1, wherein said drive means oscillates said pole means through a rotative arc of less than 90°.

8. The invention of claim 1, wherein said drive means includes a selectively operable motor having a driven shaft, lateral arm means secured to said pole means, and eccentric means on said shaft operably coupled with said arm means for swinging the latter in oscillatory fashion as said shaft is driven.

* * * * *